United States Patent [19]

Lew et al.

[11] Patent Number: 4,711,057

[45] Date of Patent: Dec. 8, 1987

[54] SUBASSEMBLY FOR GEODESICALLY REINFORCED HONEYCOMB STRUCTURES

[75] Inventors: Hyok S. Lew, 7890 Oak St., Arvada, Colo. 80005; Michael Stranahan, Woody Creek, Colo.

[73] Assignees: Jung G. Lew; Hyok S. Lew, both of Arvada, Colo.

[21] Appl. No.: 892,592

[22] Filed: Aug. 4, 1986

Related U.S. Application Data

[63] Continuation-in-part of Ser. No. 682,675, Dec. 17, 1984, Pat. No. 4,603,519.

[51] Int. Cl.[4] ..... E04B 1/32

[52] U.S. Cl. ..... 52/81; 52/609; 52/648

[58] Field of Search ..... 52/80, 86, 81, 608, 52/609, 648

[56] References Cited

U.S. PATENT DOCUMENTS

| | | | |
|---|---|---|---|
| 2,918,992 | 12/1959 | Gelsavage | 52/81 |
| 3,186,522 | 6/1965 | McCanley | 52/81 |
| 3,881,284 | 5/1975 | Martin | 52/81 |
| 3,959,937 | 6/1976 | Spunt | 52/81 |
| 4,603,519 | 8/1986 | Lew | 52/81 |

FOREIGN PATENT DOCUMENTS

| | | | |
|---|---|---|---|
| 554358 | 5/1977 | U.S.S.R. | 52/81 |

*Primary Examiner*—Henry E. Raduazo

[57] ABSTRACT

This invention discloses a subassembly for geodesically reinforced honeycomb structures, which comprises shear force and bending moment bearing structural members arranged into a hexagonal assembly that is reinforced by axial load bearing members arranged into a triangular assembly. The subassemblies are assembled and joined into a planar structure that results in a geodesically reinforced honeycomb dome or shell or plate.

20 Claims, 13 Drawing Figures

SUBASSEMBLY FOR GEODESICALLY REINFORCED HONEYCOMB STRUCTURES

This application is a continuation-in-part application to patent application Ser. No. 682,675 entitled "Geodesically Reinforced Honeycomb Structures" filed on Dec. 17, 1984, which is going to be U.S. Pat. No. 4,603,519.

BACKGROUND OF THE INVENTION

The geodesically reinforced honeycomb structures provide two advantages the well known conventional geodesic dome structures, which are, firstly, the geodesically reinforced honeycomb structures provide a much higher strength to weight ratio than the conventional geodesic structure and, secondly, the former can be constructed by assembling preassembled subassemblies while the latter does not allow such method of construction. As a consequence, the former can be constructed much faster and less expensively than the latter.

SUMMARY OF THE INVENTION

The primary object of the present invention is to provide preassembled subassemblies which are easily assembled into a geodesically reinforced honeycomb structure.

Another object is to provide a fast and efficient method for constructing geodesically reinforced honeycomb structures.

A further object is to provide a preassembled subassembly comprising shear force and bending moment bearing structural members arranged into a hexagonal assembly that is reinforced by at least one set of axial load bearing structural members arranged into a triangular assembly wherein each corner of the triangular assembly is connected to each alternate corner of the hexagonal assembly.

Yet another object is to provide the aforementioned preassembled subassembly covered with a planar member on at least one side.

Yet a further object is to provide the aforementioned preassembled subassembly comprising means for joining a plurality thereof into a geodesically reinforced honeycomb structure.

These and other objects of the present invention will become clear as the description thereof progresses.

BRIEF DESCRIPTION OF FIGURES

The present invention may be described with a great clarity and specificity by referring to the following figures.

DESCRIPTION OF THE ILLUSTRATED EMBODIMENTS

Figure 1:
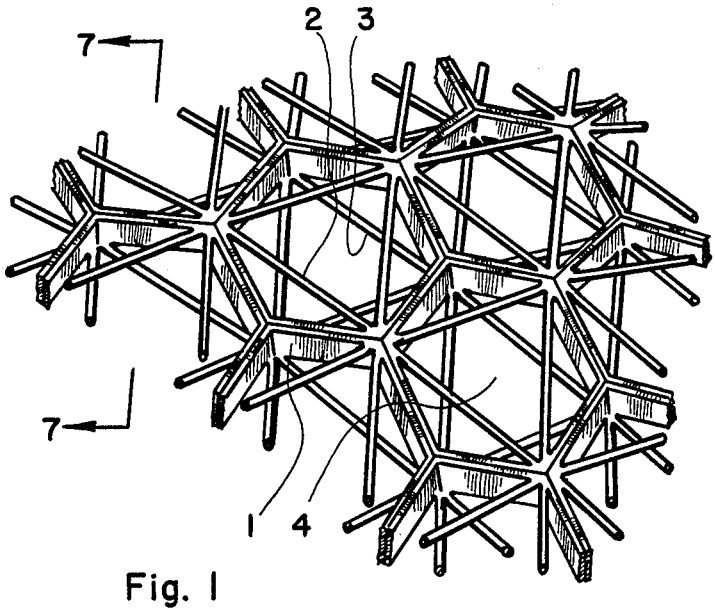
FIG. 1 illustrates a prespective view of a geodesically reinforced honeycomb structure constructed of preassembled subassemblies of the present invention.
Figure 2:
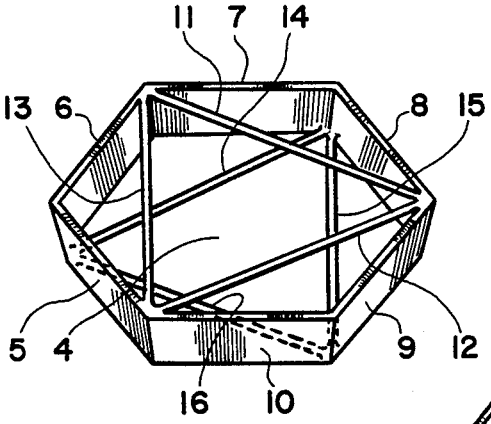
FIG. 2 illustrates an embodiment of the subassembly

In FIG. 1 there is illustrated a perspective view of a geodesically reinforced honeycomb structure constructed of a plurality of subassemblies of type shown in FIG. 2. The geodesically reinforced honeycomb structure shown in FIG. 1 comprises a honeycomb structure sandwiched between a top geodesic structure 2 and a bottom geodesic structure 3. The subassembly 4 comprises a structural member with a sizable depth arranged into a hexagonal assembly and a pair of triangular assemblies of structural members reinforcing the hexagonal assembly. The subassemblies are assembled into a geodesically reinforced honeycomb structure by joining the adjacent sides of the subassemblies by means of welding or riveting or bolt connection. The geodesically reinforced honeycomb structure can be a flat planar structure or dome or shell structure. It is so clear that one of the two layers of the geodesic structures 2 and 3 reinforcing the honeycomb structure 1 can be omitted, wherein the single geodesic structure can be disposed on top or bottom or middle surface of the honeycomb structure. It is also clear that the geodesically reinforced honeycomb structure with one or two geodesic reinforcing structures can be covered with plates or sheets or top and/or bottom surfaces.

In FIG. 2 there is illustrated a subassembly 4 employed in the construcion of the geodesically reinforced honeycomb structure (GRH Structure) shown in FIG. 1. The hexagonal assembly is essentially a short section or slice of a hexagonal shell comprising structural members 5, 6, 7, 8, 9 and 10 having a cross sectional dimension in the axial direction of the hexagonal assembly significantly greater than the cross sectional dimension in the planar direction of the hexagoanal assembly. Such cross sectional dimensions are selected to provide the shear force and bending moment bearing capacity for the structural members constituting the hexagonal assembly. The hexagonal assembly is reinforced at one planar extremity by three elongated structural members 11, 12, and 13 arranged into a triangular assembly, wherein each corner of the triangular assembly is connected to each alternating corner of the hexagonal assembly. The other planar extremity of the hexagonal assembly is reinforced by another triangular assembly comprising three elongated structural members 14, 15 and 16 wherein each corner of the triangular assembly is connected to each alternating corner of the hexagonal assembly, which corner is not connected to the corners of the triangular assembly comprising elongated structural members 11, 12 and 13.

Figure 3:
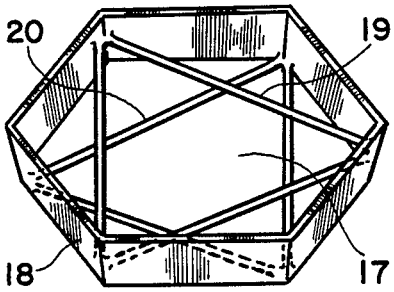
FIG. 3 illustrates another embodiment of the subassembly.

In FIG. 3 there is illustrated another embodiment of the preassembled subassembly 17 including a hexagonal assembly 18 reinforced by a pair of triangular assemblies 19 and 20 connected to the hexagonal assembly 18 in the same way as described with FIG. 2, but disposed on the middle plane instead of the two planar extremities of the hexagonal assembly. The geodesically reinforced honeycomb structure constructed of preassembled subassemblies of type 17 has a pair of reinforced geodesic structures disposed in the middle plane between the top and bottom surface of the honeycomb structure.

Figure 4:
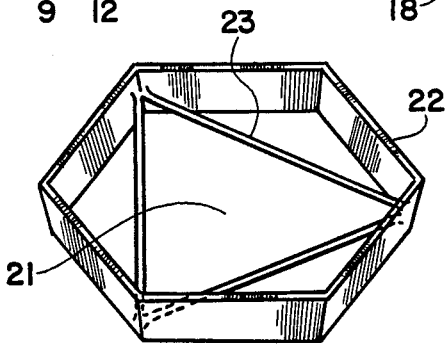
FIG. 4 illustrates a further embodiment of the subassembly.

In FIG. 4 there is illustrated a further preassembled subassembly 21 including a hexagonal assembly 22 reinforced by a single triangular assembly 23 disposed on the middle plane between the two planar extremities of the hexagonal assembly, wherein each corner of the triangular assembly 23 is connected to each alternating corner of the hexagonal assembly 22.

Figure 5:
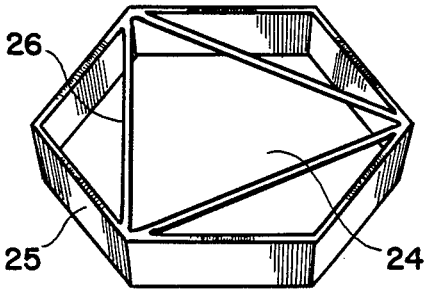
FIG. 5 illustrates yet another embodiment of the subassembly.

In FIG. 5 there is illustrated yet another preassembled subassembly 24 including a hexagonal assembly 25 and a triangular assembly 26 arranged in the same construction as that of FIG. 4 with one exception being that the triangular assembly 26 is disposed to the top planar extremity of the hexagonal assembly.

Figure 6:
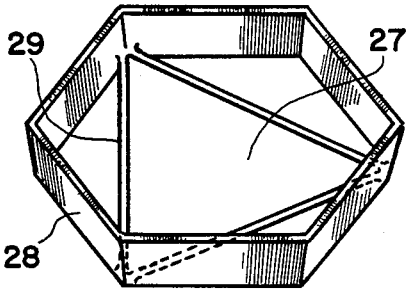
FIG. 6 illustrates yet a further embodiment of the subassembly.

In FIG. 6 there is illustrated yet a further preassembled subassembly 27 constructed in the same way as that shown in FIG. 5 with one exception being that the triangular assembly 29 is disposed to the bottom planar extremity of the hexagonal assembly 27. It should be understood that the top and bottom planar extremities of the hexagonal assembly are distinguished from each other in view that the hexagonal assembly included in the preassembled subassemblies employed in the construction of a curved geodesically reinforced honeycomb structure is of configuration of a hexagonal shell frustum. The preassembled subassemblies shown in FIGS. 2 through 6 must have a tapered hexagonal assembly like a hexagonal shell frustum if it is to be assembled into a curved geodesically reinforced honeycomb structure. They do not have any taper if they are for a flat geodesically reinforced honeycomb structure.

Figure 7:
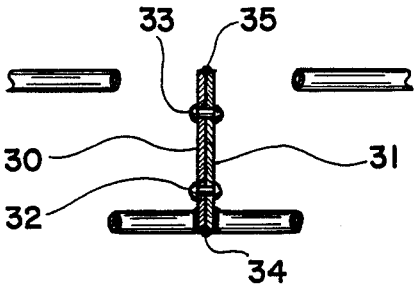
FIG. 7 illustrates a cross section of the geodesically reinforced honeycomb structure constructed of subassemblies taken along plane 7—7 as shown in FIG. 1.

In FIG. 7 there is illustrated a cross section of the geodesically reinforced honeycomb structure shown in FIG. 1, which cross section is taken along plane 7—7 as shown in FIG. 1. This cross section view illustrates how individual subassemblies are assembled into a geodesically reinforced honeycomb structure. The two adjacent structural members 30 and 31 respectively constituting the hexagonal assembly of two preassembled subassemblies are connected to one another by means of rivet or bolt connections 32, 33, etc., or by weld joints 34, 35, etc. The weld joints 34 and 35 disposed following the two mating edges of the hexagonal assemblies may be a continuous weld or a stitch weld. It may also be desirable to employ a few bolt connections such as the elements 30, 31, etc., to locate and pull the adjacent preassemblies together before permanently joining them by the weld joints 34, 35, etc.

Figure 8:
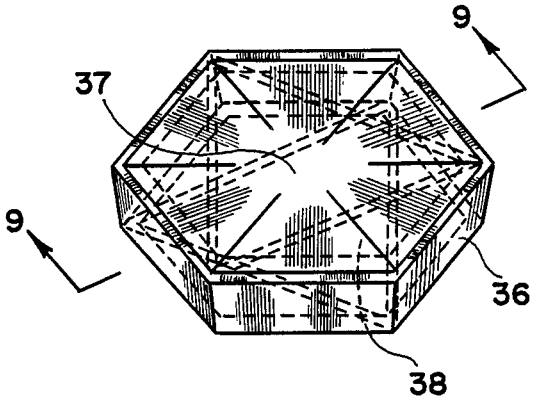
FIG. 8 illustrates an embodiment of the subassembly with covered top and or bottom.

In FIG. 8 there is illustrated an embodiment of the preassembled subassembly with a covered top and/or bottom. The two planar extremities of the preassembly 36 having essentially the same construction as the embodiment shown in FIG. 2 are covered with planar members 37 and 38 of hexagonal configuration, which planar members are welded to the hexagonal assemblies following the edge thereof. Of course, the planar members 37 and 38 may be connected to the subassembly 36 by rivetting or bolt connection instead of welding, in which case proper sealing elements must be included in the joints to prevent leaks of rain water. It is evident that the subassembly 36 may include only one planar extremity covered with a planar member leaving the other planar extremity open. The subassemblies shown in FIGS. 3 through 7 may have one or both planar extremities covered with the hexagonal planar members, which may be sheet metals, metallic plates or transparent glass or plastic panels.

Figure 9:
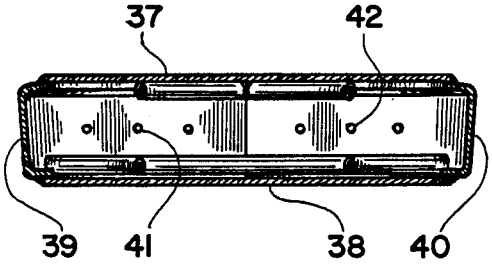
FIG. 9 illustrates a cross section of the subassembly shown in FIG. 8.

In FIG. 9 there is illustrated a cross section of the preassembly shown in FIG. 8, which cross section is taken along plane 9—9 as shown in FIG. 8. The hexagonal assembly of the preassembly 36 is constructed of structural members 39, 40, etc., with a channel shaped cross section. The hexagonal planar members 37 and 38 are welded to the flanges of the structural members 39, 40, etc. The holes 41, 42, etc., are for bolt connection or rivetting employed in locating and pulling the adjacent preassemblies together or for venting the sealed interior of the preassembly. It should be noticed that the structural channels 39, 40, etc., employed in the construction of the subassembly 36 are standard structural channels with the flanges extending from the web in a substantially 90 degree direction.

Figure 10:
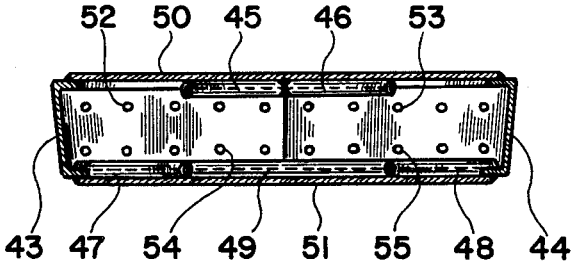
FIG. 10 illustrates a cross section of another embodiment of the subassembly with covered top and/or bottom.

In FIG. 10 there is illustrated cross section equivalent to that shown in FIG. 9 of another embodiment of the preassembled subassembly including a hexagonal assembly constructed of custom formed channel members 43, 44, etc., wherein the flanges of the structural channel members extend in an angle conforming with the taper of the hexagonal assembly defined by the webs of the structural channel members. The triangular reinforcing members 45, 46, 47, 48, 49, etc., may be round tubings or hollow bars. When both of the planar extremities the subassembly are covered with planar members 50 and 51 welded to the flanges of the structural channel members forming the hexagonal subassembly, the subassemblies assembled into a geodesically reinforced honeycomb structure must be weld connected to each other as illustrated by the welds 34, 35, etc., in FIG. 7. IF only one planar extremity of the subassembly is covered with the hexagonal planar member, the subassemblies may be assembled into a geodesically reinforced honeycomb structure by using rivetting or bolt connection utilizing holes 52, 53, 54, 55, etc., or by weld connection or by a combination of rivetting or bolt connection and welding.

Figure 11:
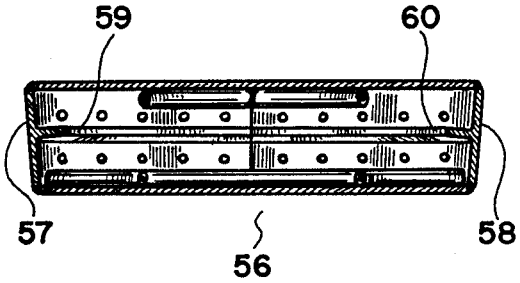
FIG. 11 illustrates a cross section of a further embodiment of the subassembly with covered top and/or bottom.

In FIG. 11 there is illustrated a cross section of a further embodiment the subassembly having essentially the same construction as that shown in FIGS. 8 and 9 with one exception. The hexagonal assembly of the subassembly 56 is constructed of the structural members 57, 58, etc., with a T-shaped cross section, wherein the flanges 59, 60, etc., are disposed within the hexagonal assembly. This assembly may have both planar extremities covered as illustrated or only one planar extremity covered.

Figure 12:
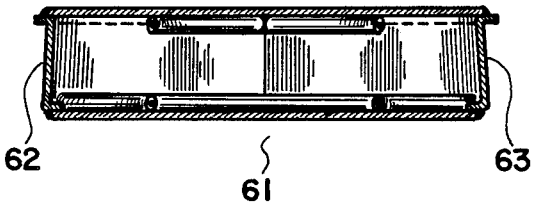
FIG. 12 illustrates a cross section of yet another embodiment of the subassembly with covered top and/or bottom.

In FIG. 12 there is illustrated a cross section of yet another subassembly 61 having essentially the same construction as the subassembly shown FIG. 10, wherein the hexagonal assembly is constructed of structural members 62, 63, etc., with a Z-shaped cross section.

Figure 13:
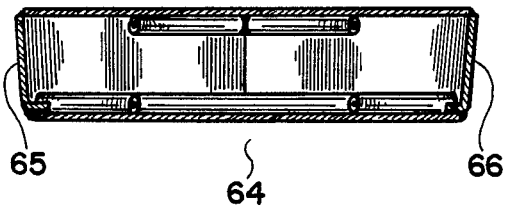
FIG. 13 illustrates a cross section of yet a further embodiment of the subassembly with covered top and/or bottom.

In FIG. 13 there is illustrated a cross section of yet a further subassembly 64 constructed in essentially the same way as the subassembly shown in FIG. 10 with one exception being that the hexagonal subassembly is constructed of structural angle members 65, 66, etc., having an L-shaped cross section. The legs of the structural members disposed on one planar extremity of the subassembly are located within the hexagonal subassembly.

It is evident that many other structural members of different cross sections such as the structural tubings of rectangular or triangular cross sections may be employed in the construction of the hexagonal assembly included in a preassembled subassembly.

While the principles of the invention have now been made clear by the illustrative embodiments, there will be immediately obvious to those skilled in the art many modifications of the structures, elements, arrangements, proportions and materials which are particularly adapted to the specific working environments and operating conditions in the practice of the invention without departing from those principles. It is not desired to limit the invention to the particular illustrated embodiments shown and described and, accordingly, all suitable modifications and equivalents may be resorted to falling within the scope of the invention as defined by the claims which follow.

The embodiments of the invention in which an exclusive property or privilege is claimed are defined as follows:

1. A subassembly for geodesically reinforced honeycomb structure comprising in combination:

(a) one or more elongated structural members capable of bearing a shearing force and bending moment arranged into a hexagonal assembly;

(b) one or more elongated structural members capable of bearing an axial loading arranged into a first triangular assembly disposed within said hexagonal assembly wherein each corner of said first triangular assembly is connected to each alternating corner of said hexagonal assembly;

(c) one or more elongated structural members capable of bearing an axial loading arranged into a second triangular assembly disposed within said hexagonal assembly wherein each corner of said second triangular assembly is connected to each alternating corner of said hexagonal assembly, said alternating corner being different from the corners of said hexagonal assembly connected to corners of said first triangular assembly; and (d) means included in said hexagonal assembly for accommodating connection means for connecting said hexagonal assembly to other hexagonal assemblies included in adjacent subassemblies to form a geodesically reinforced honeycomb structure.

2. The combination as set forth in claim 1 wherein said hexagonal assembly has substantial thickness defining two planar extremities on opposite sides of said substantial thickness; wherein said first triangular assembly is disposed adjacent to one planar extremity of said hexagonal assembly and said second triangular assembly is disposed adjacent to the other planar extremity of said hexagonal assembly.

3. The combination as set forth in claim 2 wherein said hexagonal assembly is tapered from said one planar extremity to said the other planar extremity.

4. The combination as set forth in claim 2 wherein said one planar extremity of said hexagonal assembly is covered with a planar member.

5. The combination as set forth in claim 4 wherein said hexagonal assembly is tapered from said one planar extremity to said the other planar extremity.

6. The combination as set forth in claim 4 wherein said the other planar extremity of said hexagonal assembly is covered with a planar member.

7. The combination as set forth in claim 6 wherein said hexagonal assembly is tapered from said one planar extremity to said the other planar extremity.

8. The combination as set forth in claim 1 wherein said hexagonal assembly has substantial thickness defining two planar extremities on opposite sides of said substantial thickness; wherein one planar extremity of said hexagonal assembly is covered with a planar member.

9. The combination as set forth in claim 8 wherein the other planar extremity of said hexagonal assembly is covered with a planar member.

10. The combination as set forth in claim 1 wherein said hexagonal assembly has substantial thickness defining two planar extremities on opposite sides of said substantial thickness; wherein said hexagonal assembly is tapered from one planar extremity to the other planar extremity.

11. A subassembly for geodesically reinforced honeycomb structure comprising in combination:

(a) one or more elongated structural member capable of bearing a shearing force and bending moment arranged into a hexagonal assembly;

(b) one or more elongated structural members capable of bearing an axial loading arranged into a triangular assembly disposed within said hexagonal assembly wherein each corner of said triangular assembly is connected to each alternating corner of said hexagonal assembly; and (c) means included in said hexagonal assembly for accommodating connection means for connecting said hexagonal assembly to other hexagonal assemblies included in adjacent subassemblies to form a geodesically reinforced honeycomb structure.

12. The combination as set forth in claim 11 wherein said hexagonal assembly has substantial thickness defining two planar extremities on opposite sides of said substantial thickness; wherein one planar extremity of said hexagonal assembly is covered with a planar member.

13. The combination as set forth in claim 12 wherein said hexagonal assembly is tapered from one planar extremtiry to the other planar extremity.

14. The combination as set forth in claim 12 wherein the other planar extremity of said hexagonal assembly is covered with a planar member.

15. The combination as set forth in claim 14 wherein said hexagonal assembly is tapered from one planar extremity to the other planar extremity.

16. The combination as set forth in claim 11 wherein said hexagonal assembly has substantial thickness defining two planar extremities on opposite sides of said substantial thickness; wherein said hexagonal assembly is tapered from one planar extremity to the other planar extremity.

17. The combinaiton as set forth in claim 16 wherein said triangular assembly is disposed intermediate said one and said other planar extremities of said hexagonal assembly.

18. The combination as set forth in claim 17 wherein at least one of said one and said other planar extremities of said hexagonal assembly is covered with a planar member.

19. The combination as set forth in claim 16 wherein said triangular assembly is disposed adjacent to one of said one and said other planar extremities of said hexagonal assembly.

20. The combination as set forth in claim 19 wherein at least one of said one and said other planar extremities of said hexagonal assembly is covered with a planar member.

* * * * *